US008633610B2

(12) United States Patent
Dirksen

(10) Patent No.: US 8,633,610 B2
(45) Date of Patent: Jan. 21, 2014

(54) SYSTEMS AND METHODS OF HARVESTING ENERGY IN A WELLBORE

(75) Inventor: Ronald Dirksen, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/170,961

(22) Filed: Jun. 28, 2011

(65) Prior Publication Data

US 2012/0228882 A1 Sep. 13, 2012

Related U.S. Application Data

(60) Provisional application No. 61/451,277, filed on Mar. 10, 2011.

(51) Int. Cl.
*F03B 13/00* (2006.01)
*H02P 9/04* (2006.01)
*F02B 63/04* (2006.01)

(52) U.S. Cl.
USPC ..... 290/54; 290/1 R; 166/65.1

(58) Field of Classification Search
USPC ..... 290/54, 43, 1 R; 175/93, 320; 166/66.5, 166/65.1, 242.1, 242.2, 248; 366/165.1, 366/174.1; 310/26
See application file for complete search history.

(56) References Cited

U.S. PATENT DOCUMENTS

| | | | | |
|---|---|---|---|---|
| 1,966,446 | A * | 7/1934 | Hayes | 310/26 |
| 2,490,273 | A * | 12/1949 | Kean | 310/26 |
| 2,858,108 | A * | 10/1958 | Wise et al. | 175/56 |
| 3,166,840 | A * | 1/1965 | Bancroft et al. | 228/110.1 |
| 3,790,930 | A * | 2/1974 | Lamel et al. | 367/82 |
| 5,510,660 | A * | 4/1996 | Flatau et al. | 310/26 |
| 5,671,064 | A * | 9/1997 | Buechler | 358/3.32 |
| 5,839,508 | A * | 11/1998 | Tubel et al. | 166/65.1 |
| 7,816,797 | B2 | 10/2010 | Nair | |
| 7,816,799 | B2 | 10/2010 | Nair et al. | |
| 7,816,833 | B2 | 10/2010 | Nair | |
| 2002/0039060 | A1 * | 4/2002 | Maruyama | 335/220 |
| 2005/0051323 | A1 * | 3/2005 | Fripp et al. | 166/65.1 |
| 2005/0146231 | A1 * | 7/2005 | Or et al. | 310/26 |
| 2005/0230974 | A1 * | 10/2005 | Masters et al. | 290/1 R |
| 2008/0111431 | A1 * | 5/2008 | Dorel | 310/26 |
| 2010/0308670 | A1 | 12/2010 | Nair et al. | |

* cited by examiner

*Primary Examiner* — Julio Gonzalez Ramirez
(74) *Attorney, Agent, or Firm* — Benjamin Fite; Baker Botts L.L.P.

(57) ABSTRACT

A system to harvest energy in a wellbore is disclosed. The system includes a flexible member disposed in a wellbore. The flexible member includes at least a portion of a drill string. The system includes an energy harvesting apparatus that includes magnetostrictive material and a conductor coupled to the magnetostrictive material. The energy harvesting apparatus is coupled to the flexible member to transfer forces from the flexible member to impart at least one of a strain or stress in the magnetostrictive material and to induce an electrical current in the conductor.

16 Claims, 2 Drawing Sheets

SYSTEMS AND METHODS OF HARVESTING ENERGY IN A WELLBORE

CROSS-REFERENCE TO RELATED APPLICATION

This application claims the benefit of U.S. Provisional Application No. 61/451,277, which was filed Mar. 10, 2011 and is hereby incorporated by reference in its entirety.

BACKGROUND

The present disclosure relates generally to wellbore operations and, more particularly, to systems and methods of harvesting energy in a wellbore.

Power for use in a downhole environment has generally in the past been either stored in a device, such as a battery, and conveyed downhole or it has been transmitted via conductors, such as a wireline, from the space or another remote location. As is well known, batteries have the capability of storing only a finite amount of power therein and have environmental limits, such as temperature, on their use.

Electrical conductors, such as those in a conventional wireline, provide a practically unlimited amount of power, but require special facilities at the surface for deployment and typically obstruct the production flowpath, thereby preventing the use of safety valves, limiting the flow rate of fluids through the flowpath, etc., while the conductors are in the flowpath. Thus, wireline operations are typically carried out prior to the production phase of a well, or during remedial operations after the well has been placed into production.

In wellbore drilling operations, it is desirable to provide one or more efficient power sources downhole, for example, to power downhole instrumentation. A wide variety of devices may use mechanical energy in order to perform work downhole. Those devices may be subject to a variety of forces and may release energy in a number of ways. What is needed is a method of harvesting mechanical energy downhole and generating electrical power therefrom.

BRIEF DESCRIPTION OF THE DRAWINGS

Some specific exemplary embodiments of the disclosure may be understood by referring, in part, to the following description and the accompanying drawings.

Figure 2:
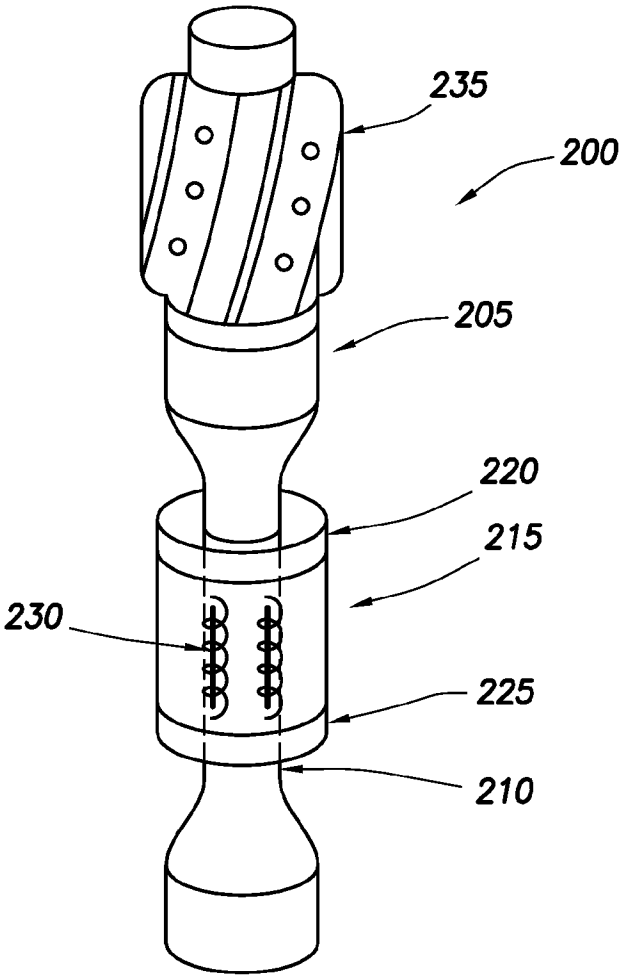
FIG. 2 is an illustration of another energy harvesting system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to wellbore operations and, more particularly, to systems and methods of harvesting energy in a wellbore.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations.

In certain embodiments according to the present disclosure, magnetostrictive technology may be capable of generating electrical power during the process of drilling a borehole by using the mechanical energy generated in a bottom hole assembly. In certain embodiments, mechanical energy may be typically generated as a result of a variety of forces bearing on a bottom hole assembly section. For example, the bottom hole assembly section may be subject to varying tension, varying flexure of its components, and/or varying revolutions per minute of the drill bit due to the stick/slip action of the drill bit and/or stabilizer(s) contacting the borehole wall. The points in the bottom hole assembly where the mechanical energy is being generated varies during the drilling process. If no special provisions are made, mechanical energy generation may not occur at all, or may occur but at insufficient levels to generate the electric energy sought. Certain embodiments according to the present disclosure provide for special provisions to ensure sufficient mechanical and electrical energy is generated at a point where magnetostrictive technology is deployed.

Magnetostrictive materials have the ability to convert kinetic energy into magnetic energy that may be used to generate electrical power. Magnetostrictive materials have the property that, when strain is induced in the material, the change in linear dimensions produces a corresponding change in magnetic field about the material. In other words, mechanical loads can deform the material and thereby rotate magnetic domains. The change of the magnetic flux can be used to generate electrical power. A suitable material for the magnetostrictive material may be Terfenol-D, available from Etrema Products, Inc. Various materials, e.g., iron and iron alloys such as Terfenol, may provide suitable magnetostrictive and giant magnetostrictive responses. These materials normally respond to a force applied to their mechanical connection by creating a magnetic field which can be detected, for example, by a coil surrounding coil.

Figure 1:
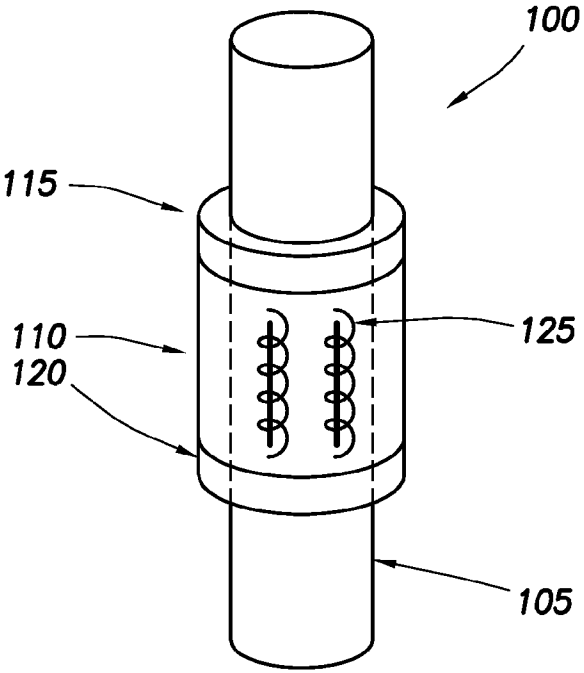
FIG. 1 is an illustration of an energy harvesting system, in accordance with certain embodiments of the present disclosure.

FIG. 1 is an illustration of an energy harvesting system 100, in accordance with certain embodiments of the present disclosure. A length of pipe 105 may be part of a bottom hole assembly, such as a drill string, in a borehole. In a drilling environment, the pipe 105 may serve several purposes, including transmitting turning forces to a drill bit on the bottom of the drill string. An energy harvesting structure 110 may be coupled to the pipe 105 by upper collar 115 and lower collar 120 which are attached to the pipe 105 in any suitable manner. In various embodiments, the collars 115 and 120 may be removably attached or fixedly attached to the pipe 105.

One or more magnetostrictive devices 125 may be mechanically coupled to the collars 115 and 120 by any suitable connections that allow transfer of forces from the collars 115 and 120 to the magnetostrictive devices 125. Each magnetostrictive device 125 may include a magnetostrictive material surrounded by a wire coil. The magnetostrictive material may be in any suitable form and, in certain embodiments, may be in the form of a rod. The wire coil forms the electrical connection of the magnetostrictive device 125. The magnetostrictive material may be made of iron or an alloy of iron with terbium and dysprosium, e.g., Terfenol-D, or any other material known to have magnetostrictive or giant magnetostrictive properties such as those listed above. The ends of the magnetostrictive material may be mechanically connected to the collars 115 and 120.

Accordingly, with energy harvesting system 100, one method of harvesting the mechanical energy and generating electrical power is by disposing one or more magnetostrictive devices 125 about a bottom hole assembly member that will flex during the drilling process. As the pipe 105 flexes and undergoes an initial strain, corresponding force may be transferred to the upper and lower collars 115 and 120 to cause resulting strain in the one or more magnetostrictive devices 125. In response to that strain, the magnetostrictive material of a magnetostrictive device 125 may generate a magnetic field, and an electric current is produced in the coils of the magnetostrictive device 125. Thus, as the pipe 105 repetitively flexes, the one or more magnetostrictive devices 125 produce corresponding repetitive electric currents.

The points in the bottom hole assembly where the energy is generated may vary during the drilling process. Bottom hole assembly modeling technology can be used to pinpoint the location(s) in the bottom hole assembly with the most deflection. Sensor technology may be deployed to measure the amount of energy at the flexible member, and drilling parameters may be adjusted in the unlikely case that not enough energy is being generated. By deploying an energy harvesting structure 110 with a flexible members at a point of the bottom hole assembly where mechanical energy is likely to occur, the likelihood of generating the sufficient energy is extremely high.

FIG. 2 is an illustration of an energy harvesting system 200, in accordance with certain embodiments of the present disclosure. The energy harvesting system 200 may include a flexible member 210, which, by way of example without limitation, may be incorporated in the form of the drill collar 205 where a section of the main body is machined away to have a diameter less than the rest of the drill collar 205 in order to make it more flexible. Because the scalloped portion of flexible member 210 makes it more flexible than other portions of the drill string, the flexible member 210 may localize the flexure in the drill collar 205 and drill string as a whole. The drill collar 205 may be coupled directly to a drill bit 235 as shown or indirectly (not shown).

An energy harvesting structure 215 may be coupled to the drill collar 205 by upper and lower collars 220 and 225 which are attached to the drill collar 205. One or more magnetostrictive devices 230 may be mechanically coupled to the collars 220 and 225 by any suitable connections that allow transfer of forces from the collars 220 and 225 to the magnetostrictive devices 230. The one or more magnetostrictive devices 230 may be implemented in similar manner to the magnetostrictive devices 125 discussed above. As the drill collar 205 flexes and undergoes strain, it will be readily appreciated that corresponding forces are transferred to the magnetostrictive devices 230 via the collars 220 and 225, thereby inducing a resulting strain in the magnetostrictive material of the magnetostrictive devices 230. In response to this strain, the magnetostrictive material generates a magnetic field and an electric current is produced in the coils of the magnetostrictive devices 230. Thus, as the drill collar 205 repetitively flexes, the magnetostrictive devices 230 produces corresponding repetitive electric currents. Further deflection can be made to occur by the addition of a stabilizer at the top, or bottom of the drill collar 205. This will also allow for ensuring the magnetostrictive technology containing casing around the collar will not actually contact the borehole wall during this process and sustain damage as a result of contact.

Figure 3C:
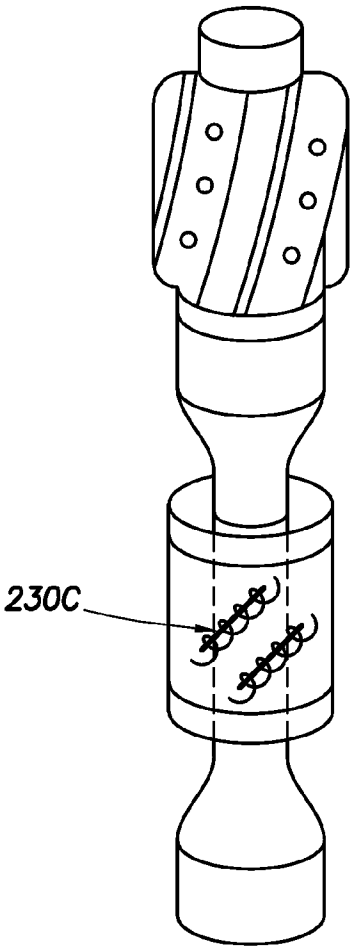
FIG. 3 is an illustration of an energy harvesting system showing embodiments where the magnetostrictive devices may be positioned at various angles to capture different flexure energies.
Figure 3B:
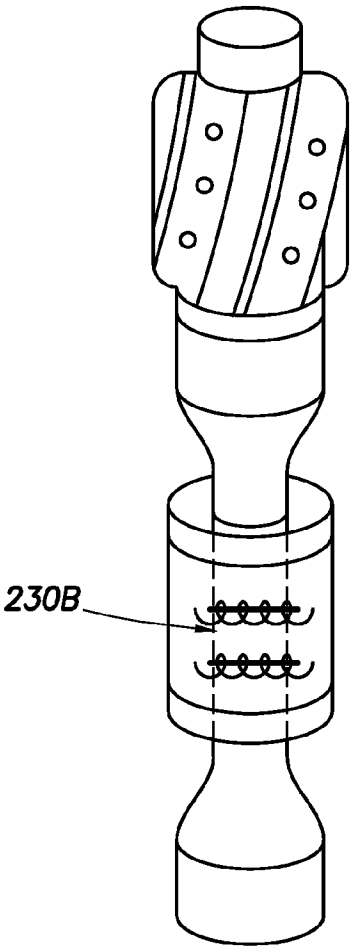
Figure 3A:
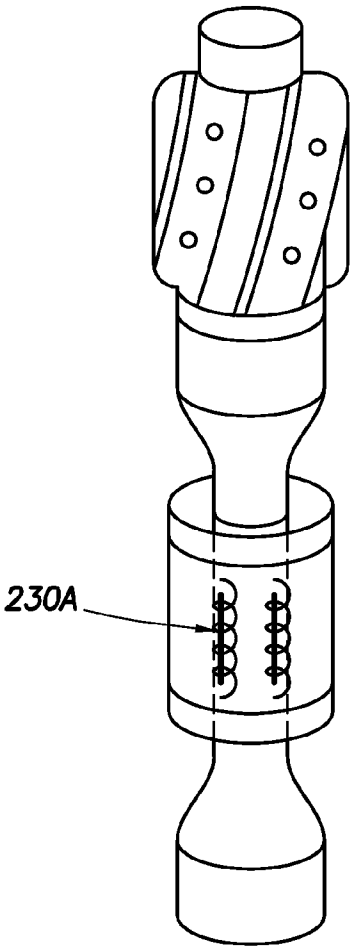

FIG. 3 is an illustration of energy harvesting system 200 showing embodiments where the magnetostrictive devices 230 may be positioned at various angles to capture different flexure energies. By way of example without limitation, the magnetostrictive devices 230 may be positioned axially as shown by magnetostrictive devices 230A, radially as shown by magnetostrictive devices 230B, and/or at a different angle as shown by magnetostrictive devices 230C. Axial orientation may be particularly advantageous for harnessing flexure due to axial tension variations and variations in the weight on the drill bit. Radial orientation may be particularly advantageous for harnessing flexure due to varying revolutions per minute of the drill bit due to the stick/slip action of the drill bit. Other angles may provide a hybrid solution between axial and radial orientations. In certain embodiments, more than one flexible member 210 and energy harvesting structure 215 may be used in a given drill string.

In addition or in the alternative, certain embodiments of energy harvesting systems according to the present disclosure may be employed as a distributed torque indicator, and certain embodiment may be employed as a weight-on-bit indicator. By placing magnetostrictive elements and associated energy harvesting structures at particular points along the drill string, the torque corresponding to those particular points of the drill string may be determined by monitoring the varying output of each distributed magnetostrictive element. The outputs may be proportional to the torque each element experiences. Such monitoring may be important in determining various parameters, e.g., friction points in the drill string. Once determined, these points may be easily reamed, thereby saving drilling time. With respect to the weight-on-bit indicator, the output from a magnetostrictive element may be used to determine this very important parameter that may, for example, be used to determine ROB (rotation of bit) and other drilling characteristics.

Accordingly, certain embodiments of the present disclosure allow for harvesting mechanical energy downhole and generating electrical power therefrom. And even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system to harvest energy in a wellbore containing a drill string comprising interconnected lengths of pipe, the system comprising:

a flexible member disposed in a wellbore, wherein the flexible member is a first length of pipe of the drill string with a smaller diameter than an adjacent second length of pipe of the drill string; and an energy harvesting apparatus coupled to an outer surface of the flexible member, the energy harvesting apparatus comprising magnetostrictive material;

a conductor disposed proximate to the magnetostrictive material;

a first collar and a second collar coupled to the flexible member to transfer forces from the flexible member to the magnetostrictive material, to impart a strain in the magnetostrictive material and to thereby induce an electrical current in the conductor.

2. The system to harvest energy in a wellbore of claim 1, wherein the flexible member is at least a portion of a drill collar.

3. The system to harvest energy in a wellbore of claim 1, wherein the energy harvesting apparatus further comprises a stabilizer.

4. The system to harvest energy in a wellbore of claim 1, wherein the strain is due, at least in part, to an axial tension of the flexible member.

5. The system to harvest energy in a wellbore of claim 1, wherein the strain is due, at least in part, to a radial tension of the flexible member.

6. The system to harvest energy in a wellbore of claim 1, wherein the magnetostrictive material comprises a rod having a longitudinal axis parallel or substantially aligned with an axis of the flexible member.

7. The system to harvest energy in a wellbore of claim 1, wherein the magnetostrictive material comprises a rod having a longitudinal axis perpendicular or substantially perpendicular with an axis of the flexible member.

8. The system to harvest energy in a wellbore of claim 1, wherein the magnetostrictive material comprises a rod having a longitudinal axis at an acute angle with respect to an axis of the flexible member.

9. A method of harvesting energy in a wellbore containing a drill string comprising interconnected lengths of pipe, the method comprising:

coupling a first collar and a second collar of an energy harvesting apparatus to an outer surface of a flexible member of a drill string to transfer forces from the flexible member to magnetostrictive material of the energy harvesting apparatus, to impart a strain in the magnetostrictive material and to thereby induce an electrical current in a conductor of the energy harvesting apparatus that is disposed proximate to the magnetostrictive material, wherein the flexible member is a first length of pipe of the drill string with a smaller diameter than an adjacent second length of pipe of the drill string; and during the operation of the drill string in a wellbore, harvesting mechanical energy of the flexible member with the energy harvesting apparatus.

10. The method of harvesting energy in a wellbore of claim 9, wherein the flexible member is at least a portion of a drill collar.

11. The method of harvesting energy in a wellbore of claim 9, wherein the energy harvesting apparatus further comprises a stabilizer.

12. The method of harvesting energy in a wellbore of claim 9, wherein the strain is due, at least in part, to an axial tension of the flexible member.

13. The method of harvesting energy in a wellbore of claim 9, wherein the strain is due, at least in part, to a radial tension of the flexible member.

14. The method of harvesting energy in a wellbore of claim 9, wherein the magnetostrictive material comprises a rod having a longitudinal axis parallel or substantially aligned with an axis of the flexible member.

15. The method of harvesting energy in a wellbore of claim 9, wherein the magnetostrictive material comprises a rod having a longitudinal axis perpendicular or substantially perpendicular with an axis of the flexible member.

16. The method of harvesting energy in a wellbore of claim 9, wherein the magnetostrictive material comprises a rod having a longitudinal axis at an acute angle with respect to an axis of the flexible member.

* * * * *